United States Patent [19]

Garwin

[11] 4,390,868

[45] Jun. 28, 1983

[54] SECURITY OF MANUFACTURED APPARATUS

[75] Inventor: Richard L. Garwin, Scarsdale, N.Y.

[73] Assignee: International Business Machines Corporation, Armonk, N.Y.

[21] Appl. No.: 206,933

[22] Filed: Nov. 14, 1980

[51] Int. Cl.[3] ..... G08B 13/00; G08B 13/18; G08B 13/24

[52] U.S. Cl. ..... 340/568; 340/380; 340/538; 340/652; 340/656; 340/815.31

[58] Field of Search ..... 340/366 R, 380, 531, 340/533, 538, 548, 568, 572, 635, 652, 653, 656, 687

[56] References Cited

U.S. PATENT DOCUMENTS

| | | | |
|---|---|---|---|
| 2,912,600 | 11/1959 | Isenberg | 340/652 |
| 3,618,065 | 11/1971 | Trip et al. | 340/280 |
| 3,643,250 | 2/1972 | Sander | 340/280 |
| 3,938,124 | 2/1976 | Way et al. | 340/531 |
| 4,252,007 | 2/1981 | Kerley | 70/57 |
| 4,262,284 | 4/1981 | Stieff et al. | 340/568 |

OTHER PUBLICATIONS

Radio Amateurs Journal, Feb. 1977, p. 47.

*Primary Examiner*—Glen R. Swann, III
*Attorney, Agent, or Firm*—Alvin J. Riddles

[57] ABSTRACT

The security of manufactured apparatus is enhanced through reducing the motivation for theft by partitioning the design of the manufactured apparatus so as to provide a component essential to the operation that is destroyed both in function and in appearance on moving the apparatus, is clearly distinguishable from a common article of commerce and cannot be singly, economically produced. The security is enhanced because theft is not profitable since a cost equal to any profit is incurred to replace the destroyed part and chance of detection is increased. Small apparatus theft, such as occurs with a typewriter, is rendered impractical by providing a power cord that is distinctive in appearance, not economically singly replaceable, that is so fastened that it must be fractured in order to remove the apparatus.

9 Claims, 5 Drawing Figures

SECURITY OF MANUFACTURED APPARATUS

TECHNICAL FIELD

Heretofore there was a general relationship between the physical size of a manufactured object and the complexity and value of the object such that small objects, manufactured in large quantities were usually not of great value and there was minimal motivation of theft. Some small objects such as jewelry were constantly attended by the user and so given a measure of protection. Further, the quantity of manufactured goods in existence and the numbers of potential owners were of an order that society could except that one acquiring a manufactured object would have some indication of the legitimacy of ownership on the part of the seller. Under such circumstances, the prohibition on receiving stolen goods was reasonably enforceable. Still further heretofore, a manufactured object was merely sold with essentially unlimited rights on the part of the purchaser to use the object in a totally unrestricted manner, including resale.

Several trends are now taking place which operate to require that the security of manufactured apparatus be more definite. One trend is that physical size is becoming smaller in relation to capabilities, and consequently sophisticated apparatus of increasing value is now capable of being physically picked up and taken. Another trend is that the volume of manufactured goods sold in commerce and in the hands of users has reached such proportions that any indication that a particular object may have been stolen is becoming unlikely. Another trend is that in some commercial endeavors a manufactured object is supplied by a service vendor for use as a monitor of the service consumed, under conditions where human monitoring is not available. A final trend is that there are some types of apparatus wherein society has established a set of conditions for operation that are acceptable in view of safety or environmental considerations, which may require that the internal settings of a manufactured object in the course of its use, should not be changed.

A need is developing for improved security from theft of or from tampering with manufactured apparatus that is sold and used in commerce.

BACKGROUND ART

In the case of the physical taking of apparatus, various alarms, such as are shown in U.S. Pat. Nos. 3,618,065 and 3,643,250 have been developed to prevent theft of portable apparatus. The word "portable" being used in the sense of a device such as a typewriter which can be picked up and carried away. Further, alarm systems have been developed to indicate the interruption of power and such a device is described in the *Radio Amateurs Journal,* February 1977, Vol. 3, No. 2, page 47 wherein light-sensitive members are incorporated in a power cord such that when the power goes off an alarm is sounded.

There is a need in the art from a manufacturing approach to improve the security of apparatus such that either the motivation for tampering or theft will be reduced or the notice that the apparatus has been stolen or tampered with will be enhanced.

DISCLOSURE OF INVENTION

Figure 1:
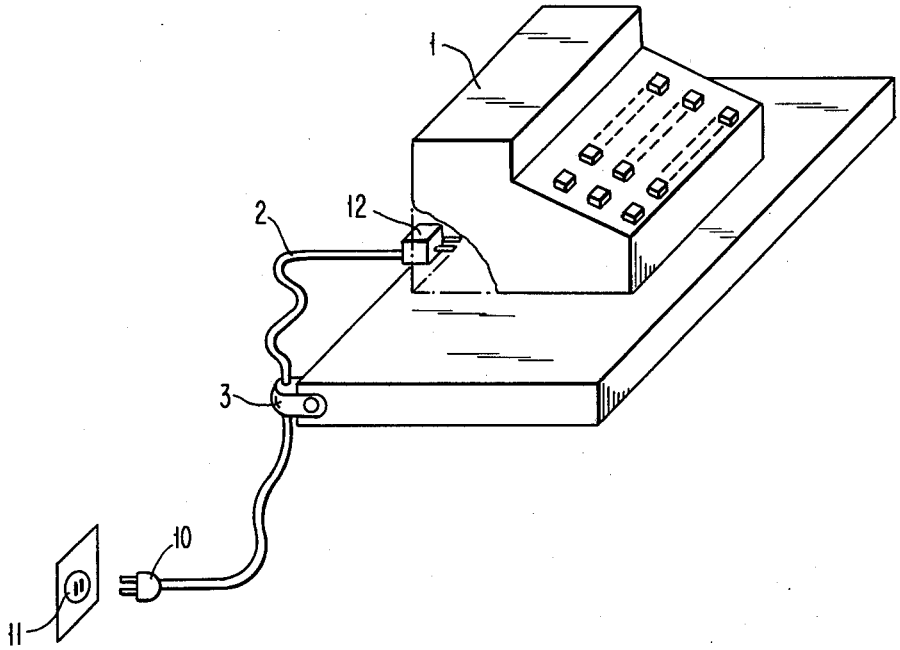
FIG. 1 is an illustration of a secured power cord embodiment of the invention.

A manufacturing technique is provided for producing apparatus with improved control over the security of the apparatus when in use. In accordance with the invention there is provided the ascription of legitimacy through the inclusion of a component in the manufacture of an object with an obvious tag associated therewith under conditions that removal will destroy or deface the tag. The component must be destroyed in connection with taking or tampering with the conditions under which the apparatus is to be operated. The apparatus is manufactured with a component that has certain attributes that in combination reduce the motivation to take or tamper with the apparatus. The attributes are as follows. The component may impart operability to the apparatus so that tampering with it disables the apparatus. The component must be visible or be such that the apparatus assembly appearance will change so that a functional replacement is readily apparent and serve as notice to an observer. The component is manufactured using process operations such that when mass-produced it does not significantly add to the cost of the apparatus but it will not be singly reproducible without a financial investment. The result is that when apparatus is manufactured in accordance with the invention incorporating a component with these attributes, any advantage such as profits from resale that may be gained from the taking or tampering of the apparatus will have been removed.

One illustration of the invention is in the prevention of a physically taking of the apparatus. The majority of instances of theft involve profit as a motivation, and where the profit can be removed from the operations of the theft and the resale, then the theft would be inhibited. The profit on any theft may be considered to be the gain from a resale minus the cost of both the theft and of any refurbishment of the apparatus in order to accomplish the resale. Since with a standard commercial article there will be a ceiling on the resale price that is limited by the legitimate sale price, then any profit from a theft can be reduced by increasing the cost of the theft operation or of increasing the cost to make possible a sale. This invention is principally directed to increasing the cost of a resale although an increase in noticeability that goods are stolen may be viewed as an increase in risk and to this extent it would be an increase in the cost of the theft.

Increasing the cost of sale will be accomplished in accordance with the invention by providing a component that is an integral part of the apparatus and which must be destroyed in order to take the apparatus. Once the component is destroyed, replacement with an identical part would require an investment to produce that would render theft uneconomical. The component also has the attribute that a subsequent purchaser would be placed on notice of the stolen nature of the device by the difference in appearance of any substitute part. This would increase the cost of sale in accordance with the invention, since the thief would have to incur an expense to replace the part and that expense would render the theft of the device unprofitable.

The invention would work best where the apparatus is a standard manufactured device having a well-known legitimate price in commerce.

In accordance with the invention the component that is manufactured into the apparatus should not be a standard commercial item and it should have a distinctive appearance. The component should be such that in large quantities it would not add substantially to the cost but it would be difficult to make by hand or in small quantities. Operations that employ specialized tools such as mass production tools are the preferred fabrication approach. The manufacturing operations such as molding, stamping and masking employ tools that require a capital investment and are examples of satisfactory operations for the invention. The integrated circuit where it is not an article of commerce will satisfy the requirements of the invention. The functional replacement thereof should be costly and/or readily visible. The integrated circuit may be mounted to require destruction or be incorporated in a circuit that provides a damaging electrical impulse on disassembly.

One illustration for electrical apparatus is a distinctive power cord not available as a standard commercial item, somewhat expensive to reproduce singly and that is secured so firmly to a relatively immovable object that the cord must be cut in order to remove the apparatus.

Another illustration for a service such as electricity, gas or cable entertainment would involve monitoring apparatus such as a meter. The individuals to whom the service is supplied are usually so large in number and so widely scattered that other than occasional human monitoring is impractical and very costly. In this type of commercial endeavor the service provider would probably supply but not sell the monitoring apparatus. In accordance with the invention, the component that must be destroyed in order to tamper with the meter should be such that the member would not be readily reproducible and the destruction of the member would interrupt the power. The termination of service would both remove motivation and would operate to notify the provider of the service that a human monitor should investigate.

In still another illustration there are certain kinds of apparatus that have some detrimental aspects but the apparatus also has sufficient advantages that society has determined that it will permit operation within a precise range. For example, apparatus that emit chemicals such as the internal combustion engine may be required after sale to be confined to operations that represent a tradeoff between the most efficient operation of the device and the quantity of chemical emission. It is important if this tradeoff is to be maintained that the device be manufactured so that in operation the security of the adjustments that establish the acceptable tradeoff not be breached. In accordance with the invention, the settings that establish the acceptable operation conditions are arranged so that a component must be destroyed to change it. Where such tampering takes place, the engine would be rendered inoperable, a replacement component would be expensive and if a substitute were employed, the fact that the tampering took place would be immediately obvious. Similarly, an automobile governor or speed-limiting device may be protected against being disabled or removed.

BEST MODE FOR CARRYING OUT THE INVENTION

In accordance with the invention a unique part is provided that is integral with the apparatus so that the part must be destroyed to breach the security of the apparatus. Legitimate replacement of the part is retained within the manufacturer's control. The part is not a standard article of commerce, and it has a distinctive appearance so that any substitute will be visually apparent. The part cannot be inexpensively duplicated singly or in small quantities. The combination of these characteristics will operate to advance the security and to prevent both tampering and theft of apparatus.

Referring to FIG. 1, a schematic illustration is provided of the preferred embodiment, the prevention of theft of a piece of valuable apparatus labelled element 1 such as a typewriter or computer terminal which is portable enough to be physically picked up and carried away. The apparatus 1 is equipped in accordance with the invention with a special power cord labelled element 2. The power cord 2 is secured at point 3 to a massive object such that in order to physically remove the apparatus 1 it will require cutting of the power cord 2. In accordance with the invention, the power cord 2 is so constructed that an identical replacement cannot be made economically as a single unit and that functional substitution with a standard article of commerce will have a different appearance and hence will serve as a source of notice both to any subsequent purchaser and law enforcement person that the apparatus 1 may have been stolen. The manufacturer, of course, can provide replacement power cords to legitimate owners of damaged cords upon demonstration of legitimacy of ownership.

Under these conditions since the power cord 2 must be destroyed in taking the apparatus 1, any replacement will either cost so much as to render the theft unprofitable or will provide the apparatus with an appearance that will place others on notice that the goods have possibly been stolen.

Figure 2:
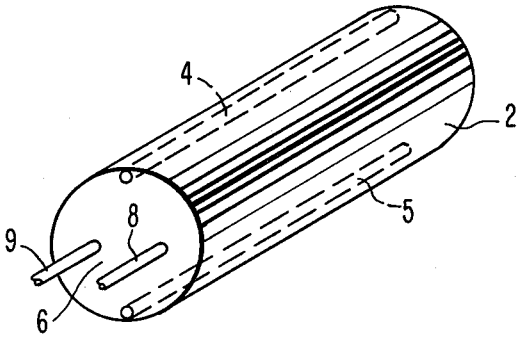
FIG. 2 is a detailed illustration of a cross section of the cord of FIG. 1.
Figure 3:
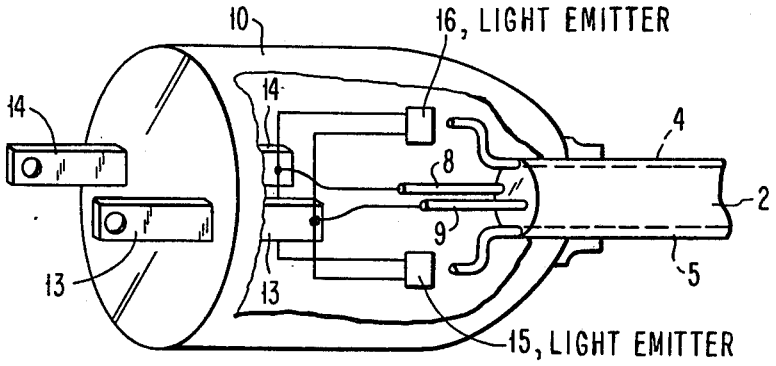
FIG. 3 is a functional detail of the connector to the powerline for the cord of FIGS. 1 and 2.
Figure 4:
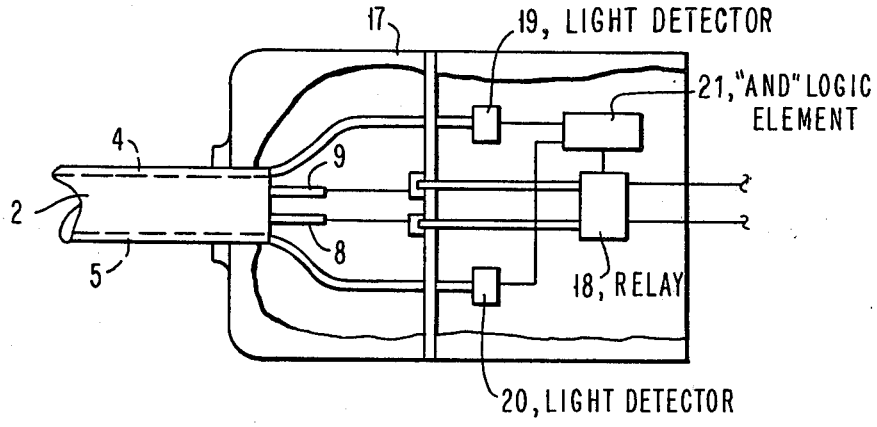
FIG. 4 is a functional detail of a connection at the apparatus for the power cord of FIGS. 1 and 2.

A more detailed illustration of the power cord 2 may be seen in connection with FIGS. 2, 3 and 4. In FIG. 2 the power cord 2 is provided with optical transmission members such as optical fibers or plastic stripes 4 and 5, molded into the insulation 6 surrounding the electrical wires 8 and 9. The members 4 and 5 give a distinct appearance and serve for a continuity monitor. A connector to the power line is provided as element 10 adapted for power line outlet 11. A connector 12 is provided at the apparatus 1.

The purpose to be achieved is to provide a structure that when destroyed cannot be readily replaced by a standard article of commerce and has an appearance such as to give notice to a purchaser that there may be a question as to the legitimacy of ownership. The power cord 2 is equipped with a source of light at the power line connector which provides light transmission along the length of the cord. The apparatus or the cord is equipped with light presence indications at the connector to the apparatus or inside the apparatus housing. The apparatus 1 is constructed to require the presence of both the light and the power to be operative. Additionally, the light emitted from the fibers along the length of the cord provide an unusual and not readily duplicated appearance to assure the user that the apparatus 1 has not been removed from its legitimate location.

In FIG. 3 a cut-away functional illustration is provided of a plug type connector 10 to the power line outlet 11 of FIG. 1. The cord 2 power wires 8 and 9 are connected to the prongs 13 and 14 of the connector 10. Electrooptical transducing capability is provided in the form of light emitting members 15 and 16 each of which is connected across prongs 13 and 14 and each is optically coupled to a respective light conductors 4 and 5 such as a plastic stripe or optical fiber. In this structure when the power cord 2 is plugged into the outlet 11, light is generated in the power line connector 10 that is transmitted in light conductors 4 and 5 along the length of the power cord 2, some of it emerging either continuously along the length of the cord 2 or at intervals.

Referring next to FIG. 4, a cut-away functional illustration is provided of the connection of the power cord 2 inside or at the housing of the apparatus 1. The illustration in FIG. 4 shows capability for indicating the presence of the light signal along the power cord 2 and capability in the apparatus to have operation of the apparatus 1 be contingent on the presence of both the light and the power. In FIG. 4 the power cord 2 with the power wires 8 and 9 and the light conducting members 4 and 5 enters a housing 17 in the apparatus 1. The power conductors 8 and 9 are connected and disconnected through the points, not shown, of a relay 18. The relay 18 is actuated by the detected presence of light at light detectors 19 and 20 which through an "AND" logic circuit 21 indicate that both light conductors 4 and 5 are intact.

The power cord of the invention through the light conducting members and sensing capability has both a distinctive appearance and a light continuity dependence for operation.

While multiple light conductors are shown it will be apparent to one skilled in the art that a single power cord continuity member may be used.

A power cord such as illustrated as element 2 would not be a standard article of commerce. While in large quantity manufacture it would not add substantially to the cost of the apparatus 1, it would be sufficiently costly to duplicate singly that it would thereby render a theft unprofitable. Any theft would require cutting the power cord 2 because of the fastening at point 3. The lack of light continuity would result in disablement of the device. If a substitution is arranged by using a standard power cord sold in commerce not only would a costly bypass of the light-sensing elements 18, 19 and the elements 20 and 21 in the apparatus be required but any subsequent purchaser would be placed on notice and would thus be made an accessory to the theft activity.

Figure 5:
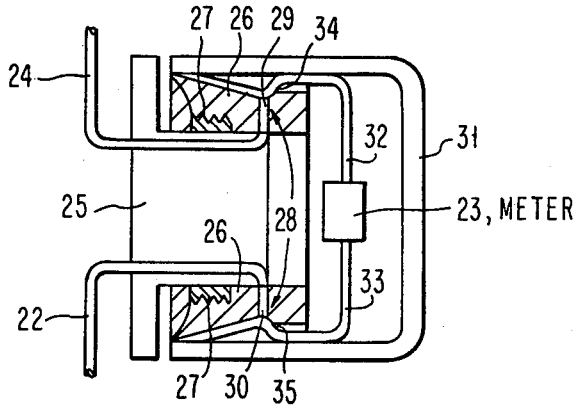
FIG. 5 is an illustration of an alternate embodiment of the invention.

In FIG. 5 an alternate embodiment is shown wherein a service monitoring apparatus such as a power meter is illustrated schematically. In this illustration a service item such as power is delivered via a conductor 22 to a meter 23 which monitors the quantity used by a user through a cable 24.

In accordance with the invention the cables pass through a mounting plate 25. An element 26 is threaded at 27 onto the plate 25 and is provided with a shoulder 28 and conductive inserts 29 and 30, each for the input 22 and output 24 cables. A housing 31 is provided with attached conductors 32 and 33. The conductors 32 and 33 provide electrical contact from the meter 23 through the inserts 29 and 30 to cables 22 and 24. The meter 23 is visible through a glass face of the housing 31, not shown. Each of conductors 32 and 33 has a spring shoulder portion 34 and 35 such that the housing 31 can be pushed into place and once the shoulders 34 and 35 are behind the shoulder 28 of element 26, the element 26 must be broken to disassemble the housing 31. This will then interrupt the power between cables 22 and 24.

The member 26 with conductive inclusions 29 and 30 is not a standard article of commerce and is available only through control of the service vendor. The element 26 is reproducible in large quantities with a moderate increment of cost, but the cost increment of manufacturing singly would both discourage the tampering and make it apparent. The interruption of power will immediately inform the power vendor that the interruption has taken place and consequently the gain from the tampering with the service will be inhibited.

In the light of the above principles it will be apparent that many arrangements in today's environment will benefit from the concept of the invention and the security of any piece of manufactured apparatus will be enhanced.

Having thus described my invention, what I claim as new, and desired to secure by Letters Patent is:

1. A power cord of the type that delivers electrical power from a disconnectable source to a power-dependent apparatus the improvement comprising:
   at least two power delivery conductors;
   at least one signal bearing member of the type capable of transmitting at least one of optical and electrical signals; positioned visibly along the length of, insulated from, and contiguous with said power delivery conductors;
   electrical-to-optical signal transducer means located at, at least one of said disconnectable source and said apparatus and operable to provide a light signal through said signal bearing member; and
   optical-to-electrical signal transducer means at the other of said at least one of said disconnectable source and said apparatus responsive to said light signal; and indicating continuity conditions along said power cord.

2. The power cord of claim 1 wherein said signal bearing member is a light conducting strip.

3. The power cord of claim 2 wherein light in said light conducting strip is visible to an observer.

4. The power cord of claim 2 wherein said electrical-to-optical signal transducer means is at least one light emitting diode.

5. The power cord of claim 4 wherein said optical-to-electrical signal transducer means is at least one photocell.

6. The power cord of claim 5 wherein the light in said light conducting strip is visible to an observer.

7. An enhanced security assembly comprising:
   a multicomponent apparatus capable of performing a function,
   at least one security enhancement component portion of said apparatus said security enhancement component being essential to the performance of said function of said apparatus and said security enhancement component further having an appearance different from a standard article of commerce,
   a stationary member,
   means retaining at least a portion of said security enhancement component to said stationary member, said retaining means being sufficient to require destruction of at least one of function and appearance of said security enhancement component in order to effect separation.

8. The apparatus of claim 7 wherein said security enhancement component is a power cord.

9. The apparatus of claim 7 wherein said security enhancement component has at least a portion thereof that is integral with the housing of said apparatus.

* * * * *